US010767425B2

(12) United States Patent
Meuth et al.

(10) Patent No.: US 10,767,425 B2
(45) **Date of Patent: *Sep. 8, 2020**

(54) WRENCH ASSEMBLY WITH ECCENTRICITY SENSING CIRCUIT

(71) Applicant: FORUM US, INC., Houston, TX (US)

(72) Inventors: Joshua Brandon Meuth, Giddings, TX (US); Han Vo, Cypress, TX (US)

(73) Assignee: FORUM US, INC., Houston, TX (US)

( * ) Notice: Subject to any disclaimer, the term of this patent is extended or adjusted under 35 U.S.C. 154(b) by 232 days.

This patent is subject to a terminal disclaimer.

(21) Appl. No.: 15/952,561

(22) Filed: Apr. 13, 2018

(65) Prior Publication Data

US 2019/0316428 A1 Oct. 17, 2019

(51) Int. Cl.
*E21B 19/16* (2006.01)

(52) U.S. Cl.
CPC ..... *E21B 19/161* (2013.01)

(58) Field of Classification Search
CPC ..... E21B 19/161–163
USPC ..... 81/57.15–57.21
See application file for complete search history.

(56) References Cited

U.S. PATENT DOCUMENTS 2,871,044 A 1/1959 Peterson et al.
3,589,742 A 6/1971 Flick
3,921,473 A * 11/1975 Boyadjieff ..... E21B 19/16 81/57.34
4,648,292 A 3/1987 Haynes et al.
5,404,959 A * 4/1995 Adkins, Sr. ..... F16P 3/144 175/24
6,263,763 B1 7/2001 Feigel, Jr. et al.
6,318,214 B1 11/2001 Buck
6,439,316 B1 * 8/2002 Penisson ..... E21B 19/164 173/1
7,000,503 B2 * 2/2006 Dagenais ..... E21B 19/166 81/57.35
7,036,396 B2 5/2006 Moe et al.
7,891,418 B2 2/2011 Begnaud et al.
7,958,787 B2 6/2011 Hunter
8,074,537 B2 12/2011 Hunter
8,291,791 B2 * 10/2012 Light ..... E21B 19/164 81/57.16
8,733,213 B2 * 5/2014 Taggart ..... E21B 19/161 81/57.11
10,366,507 B2 * 7/2019 Amezaga ..... E21B 41/00
2002/0189804 A1 12/2002 Liess et al.
2008/0307930 A1 12/2008 Veverica et al.
2008/0307932 A1 12/2008 Lauzon et al.
(Continued)

OTHER PUBLICATIONS

International Search Report and Written Opinion dated Jun. 25, 2019, corresponding to Application No. PCT/US2019/025853.
(Continued)

*Primary Examiner* — Hadi Shakeri
(74) *Attorney, Agent, or Firm* — Patterson & Sheridan, L.L.P.

(57) ABSTRACT

A wrench assembly comprising an upper clamp assembly, a lower clamp assembly coupled to the upper clamp assembly, an alignment device disposed between the upper and lower clamp assemblies to allow the upper clamp assembly to move laterally relative to the lower clamp assembly when rotated relative to the lower clamp assembly, and an eccentricity sensing mechanism coupled between the upper clamp assembly and the lower clamp assembly.

19 Claims, 17 Drawing Sheets

(56) References Cited

U.S. PATENT DOCUMENTS

| | | | | |
|---|---|---|---|---|
| 2010/0199812 | A1 | 8/2010 | Richardson | |
| 2011/0259576 | A1 | 10/2011 | Mulder et al. | |
| 2018/0073312 | A1* | 3/2018 | Clostio, Jr. ..... | E21B 19/24 |

OTHER PUBLICATIONS

International Search Report and Written Opinion dated Aug. 20, 2018, Corresponding to Application No. PCT/US2018/031951.
Gulf Cooperation Office Action dated Nov. 26, 2019 for Application No. 2018-35399.
European Office Action dated Jan. 10, 2020 for Application No. 18727590.4.
Non-Final Office Action dated Jan. 11, 2019 for U.S. Appl. No. 15/609,279.

* cited by examiner

WRENCH ASSEMBLY WITH ECCENTRICITY SENSING CIRCUIT

BACKGROUND

Field

Embodiments disclosed herein relate to a wrench tool assembly for coupling or de-coupling tubulars in a drilling or workover operation utilized in the oil and gas industry.

Description of the Related Art

A spinner and wrench tool (also known as a "spinner and tong") is commonly used in the oil and gas industry to rotate a tubular when making up or breaking out a threaded connection. The spinner and wrench tool rotates a tubular relative to another tubular to thread the tubulars together during a make-up operation, and rotates the tubular in an opposite direction to unthread the tubulars from each other during a break-out operation. The spinner is a relatively low torque, high speed device used for the initial makeup of a threaded connection, while the wrench is a relatively high torque, low speed device that is coupled to the spinner and subsequently used to provide a greater amount of torque to complete the threaded connection.

The wrench (also known as a "power tong") may be composed of upper and lower torque bodies having a plurality of grippers that are moved into contact with the tubulars. The upper torque body is configured to rotate one of the tubulars relative to the other tubular, which is held stationary by the lower torque body, to couple or decouple the tubulars. One problem that often occurs is the grippers grip the tubular in a position such that the center axis of the tubular is offset from the center axis of the wrench. This is caused when some of the grippers contact the tubular prior to the other grippers, which results in a misalignment of the wrench with the center axis of the tubular. The improper alignment between the wrench and the center axis of the tubular often results in a misapplication of the appropriate amount of torque to a threaded connection, thereby potentially resulting in a leak in the threaded connection.

Therefore, there exists a need for new and/or improved wrench tools.

SUMMARY

In one embodiment, a wrench assembly is provided that includes an upper clamp assembly, a lower clamp assembly coupled to the upper clamp assembly, an alignment device disposed between the upper and lower clamp assemblies to allow the upper clamp assembly to move laterally relative to the lower clamp assembly when rotated relative to the lower clamp assembly, and an eccentricity sensing mechanism coupled between the upper clamp assembly and the lower clamp assembly.

In another embodiment, a wrench assembly is provided that includes an upper clamp assembly, a lower clamp assembly coupled to the upper clamp assembly, an alignment device disposed between the upper and lower clamp assemblies, wherein the alignment device is configured to adjust an axis about which the wrench assembly applies torque by allowing the upper clamp assembly to move laterally relative to the lower clamp assembly, and an eccentricity sensing mechanism coupled between the upper clamp assembly and the lower clamp assembly and configured to stop the lower or upper clamp assembly from applying torque to a tubular connection.

In another embodiment, a wrench assembly is provided that includes an upper clamp assembly, a lower clamp assembly coupled to the upper clamp assembly, an alignment device disposed between the upper and lower clamp assemblies, wherein the alignment device is configured to adjust an axis about which the wrench assembly applies torque by allowing the upper clamp assembly to move laterally relative to the lower clamp assembly, wherein the alignment device includes a wedge that engages a groove, the wedge being movable relative to a plate member of the lower clamp assembly, and an eccentricity sensing mechanism coupled between the upper clamp assembly and the lower clamp assembly and configured to stop the lower or upper clamp assembly from applying torque to a tubular connection.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a wrench tool for making up and breaking out a threaded connection between two tubulars. The wrench tool may be used with a spinner tool. While the spinner tool is a relatively low torque, high speed device used for the initial makeup of the threaded connection, the wrench tool is a relatively high torque, low speed device that is coupled to the spinner tool and is subsequently used to provide a greater amount of torque to complete the threaded connection.

The wrench assembly includes an upper clamp assembly and a lower clamp assembly. During a make-up or break-out operation, the upper clamp assembly grips and rotates one tubular relative to another tubular, which is gripped and held stationary by the lower clamp assembly. The wrench assembly is used to apply a specified torque value to a threaded connection between two tubulars. The upper and lower clamp assemblies are at least partially laterally movable relative to each other by a torque alignment device comprising a wedge and groove engagement to account for any eccentricity between a center axis of the tubulars and a center axis of the wrench assembly. The wedge and groove engagement allows the upper clamp assembly to move laterally out of alignment with the lower clamp assembly when applying torque, and forces the upper clamp assembly body back into alignment with the lower clamp assembly after applying torque.

When the wrench assembly is applying torque to the tubulars, the torque applied is at a maximum when the center axis of the tubulars is aligned with the center axis of the wrench assembly, which is the axis about which the maximum amount of torque can be applied by the wrench assembly. Any eccentricity between the center axis of the tubulars and the axis about which torque is applied may adversely affect the actual amount of torque that is applied to the threaded connection between the tubulars. To compensate for any eccentricity between the center axis of the tubulars and the axis about which torque is applied, the upper and lower clamp assemblies of the wrench assembly are configured to move laterally relative to each other to enable the torque to be applied about the center axis of the tubulars and not the center axis of the wrench assembly, thereby applying maximum torque to the threaded connection.

Figure 1:
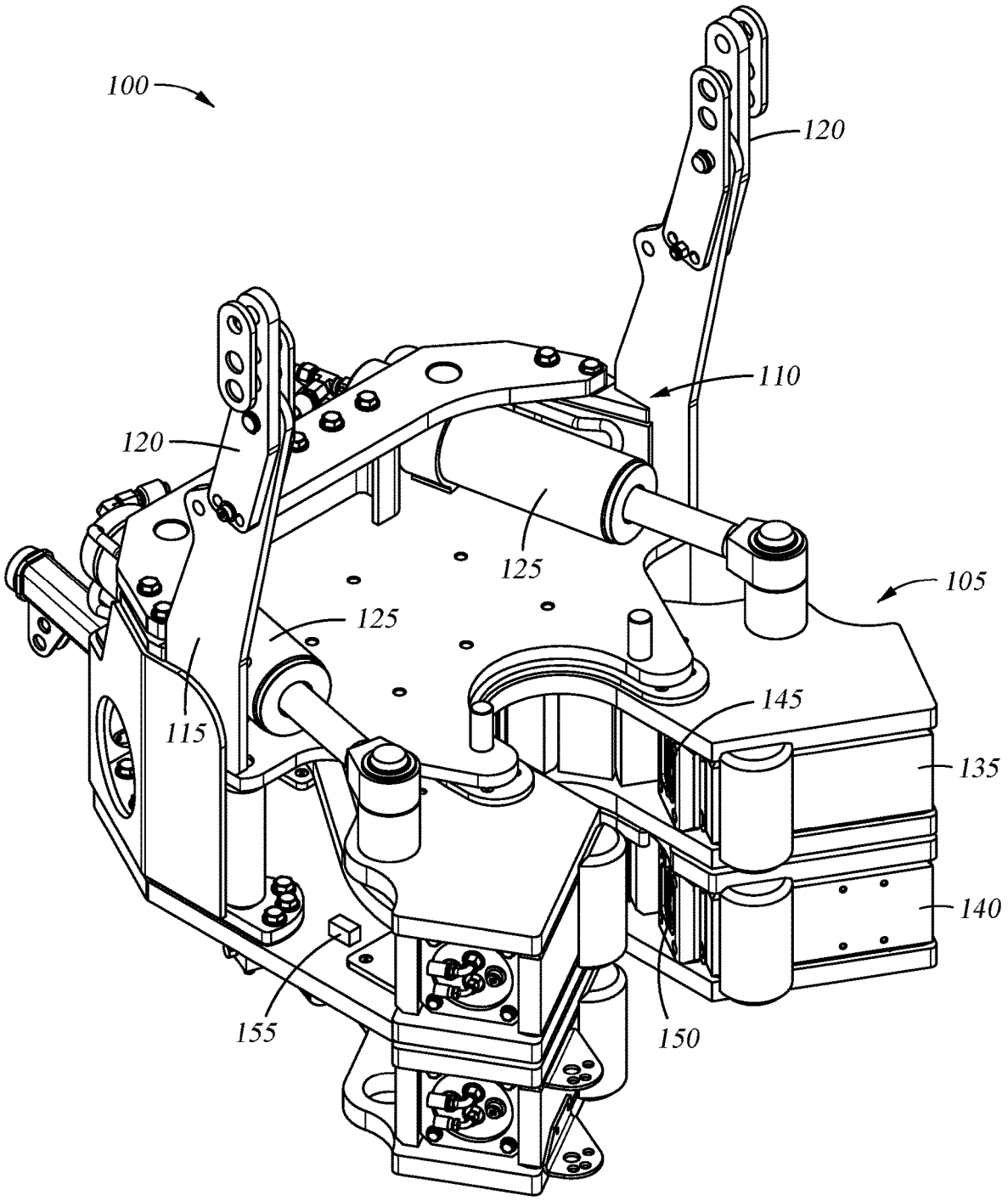
FIG. 1 is an isometric view of a wrench tool according to one embodiment.
Figure 2:
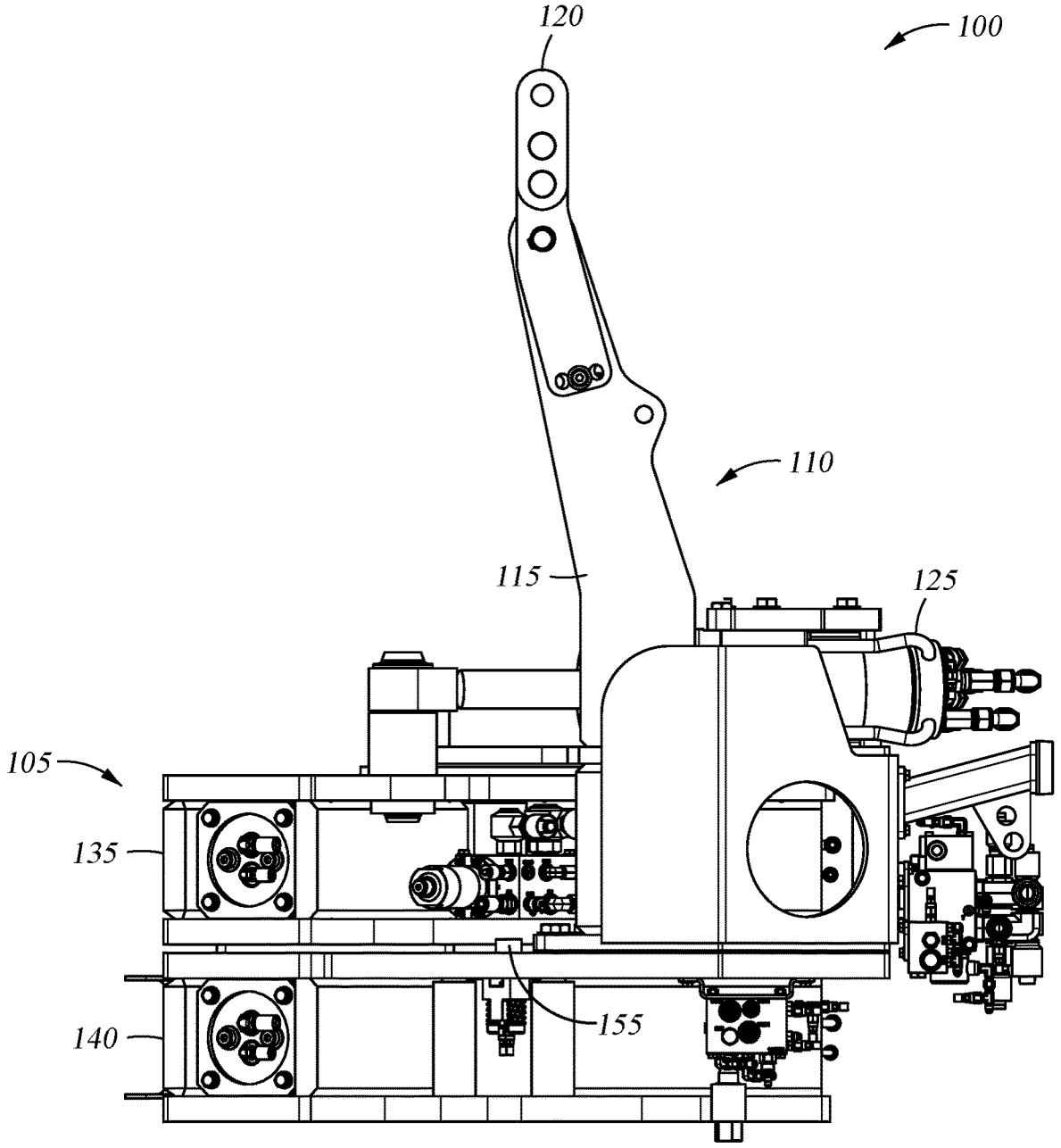
FIG. 2 is a side view of the wrench tool of FIG. 1.
Figure 3:
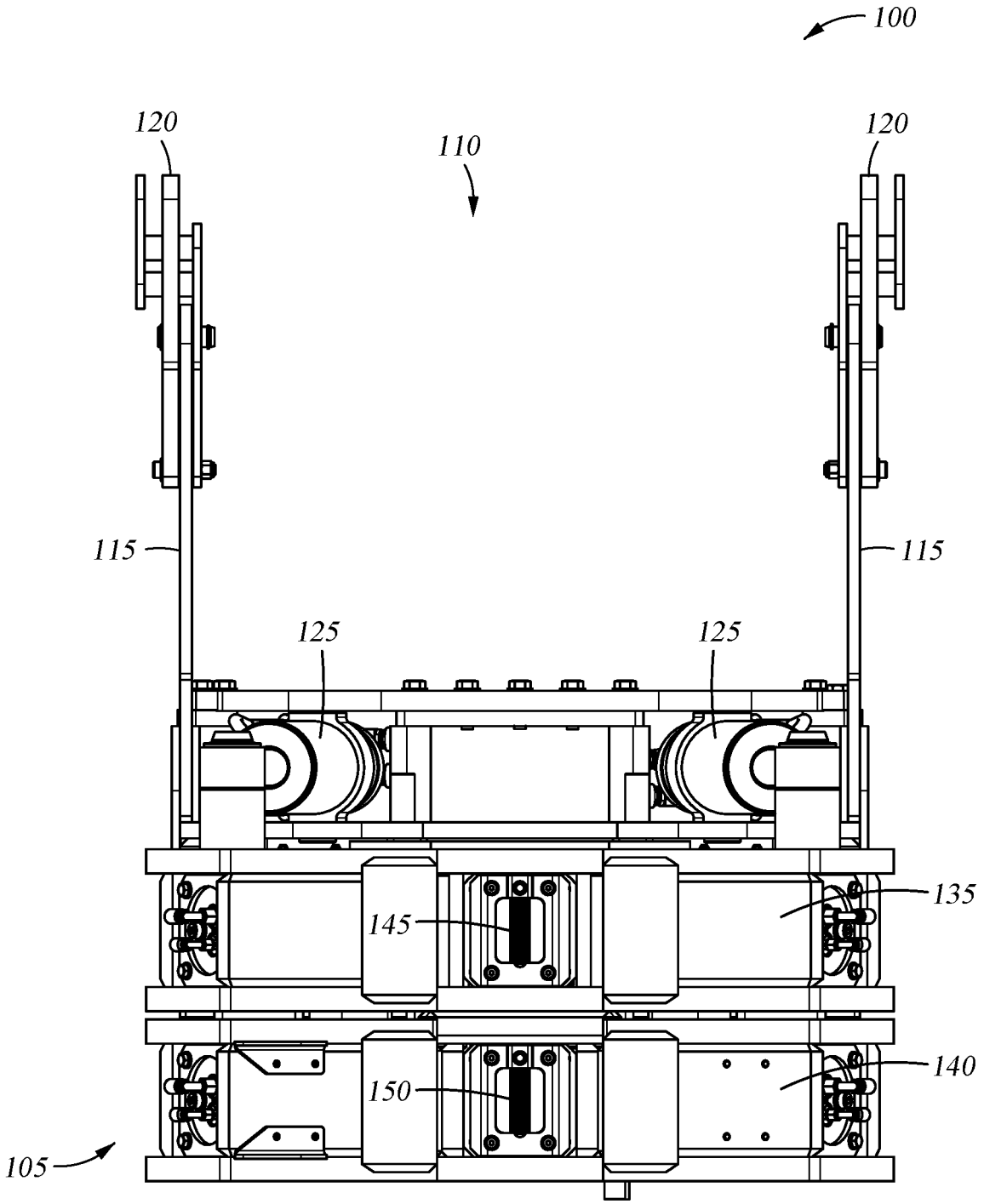
FIG. 3 is a front view of the wrench tool of FIG. 1.
Figure 4:
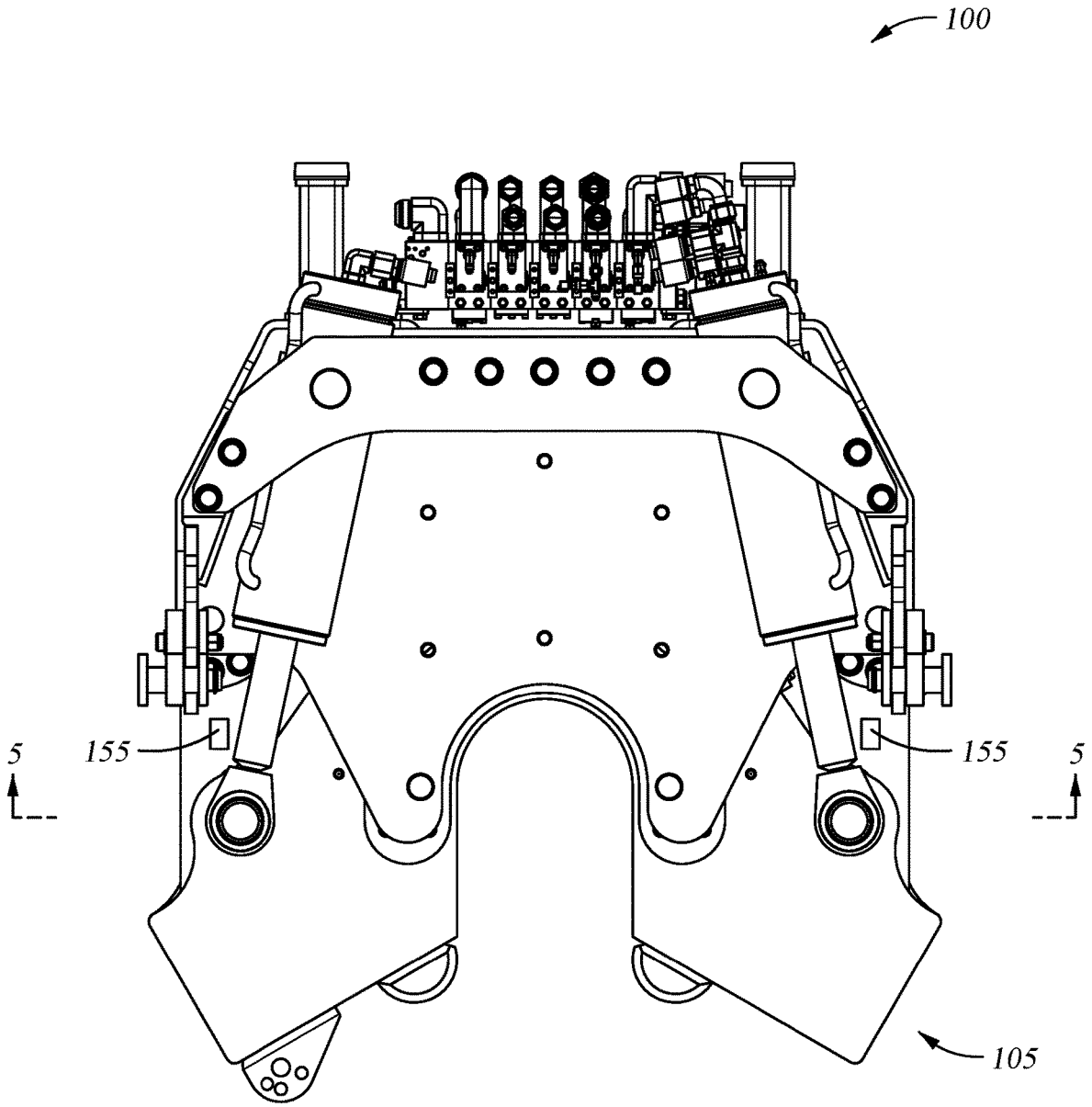
FIG. 4 is a top plan view of the wrench tool of FIG. 1.
Figure 5:
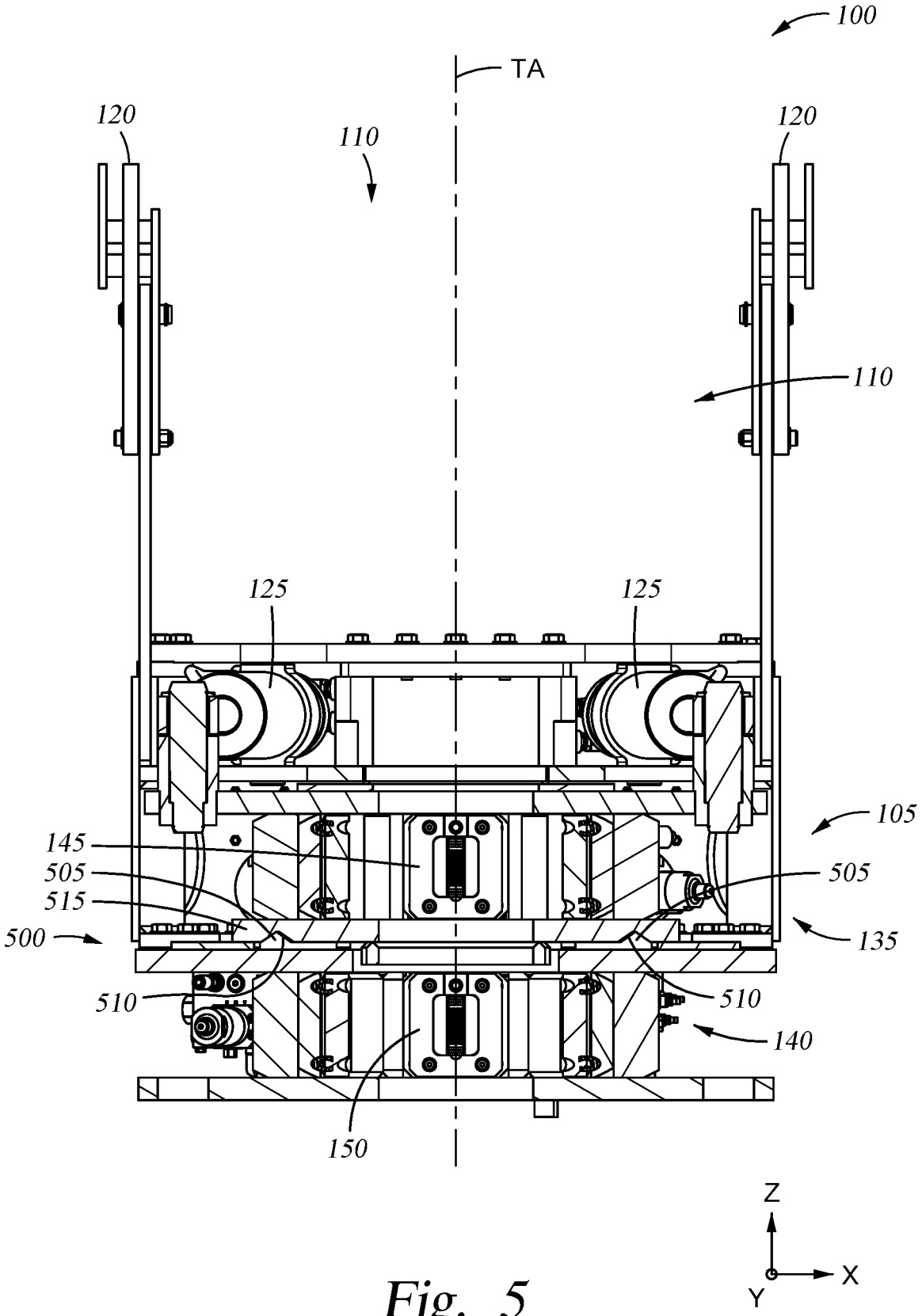
FIG. 5 is a sectional view of the wrench tool along lines 5-5 of FIG. 4.

FIGS. 1-5 are various views of one embodiment of a wrench tool 100. FIG. 1 is an isometric view of the wrench tool 100. FIG. 2 is a side view of the wrench tool 100. FIG. 3 is a front view of the wrench tool 100. FIG. 4 is a top view of the wrench tool 100. FIG. 5 is a sectional view of the wrench tool along lines 5-5 of FIG. 4.

The wrench tool 100 includes a wrench assembly 105 coupled to a support structure 115. The support structure 115 may include hangers 120 for suspending the wrench tool 100. A space 110 may be provided between the hangers 120 for a spinner tool (not shown).

The wrench assembly 105 includes an upper clamp assembly 135 and a lower clamp assembly 140. The wrench assembly 105 also includes hydraulic cylinders 125 that move the upper clamp assembly 135 relative to the lower clamp assembly 140 along a tool axis TA (shown FIG. 5). The upper clamp assembly 135 and the lower clamp assembly 140 include a plurality of grip assemblies 145 and 150, respectively (some are shown in FIGS. 1 and 3). The grip assemblies 150 of the lower clamp assembly 140 may be used to grip a box end of a first tubular, and the grip assemblies 145 of the upper clamp assembly 135 may be used to grip a pin end of a second tubular.

In a make-up operation, the wrench tool 100 is brought into proximity with a first tubular that is held by a rotary spider on a rig floor for example. The grip assemblies 150 of the lower clamp assembly 140 are actuated to grip the box end of the first tubular. A pin end of a second tubular is positioned on top of the box end of the first tubular, for example by an elevator or top drive (not shown).

The second tubular is rotated by a spinner tool (not shown) to initially make up the threaded connection between the tubulars. After the initial make up, the grip assemblies 145 of the upper clamp assembly 135 are actuated into contact with the pin end of the second tubular, while the box end of the first tubular remains gripped by the lower clamp assembly 140. The upper clamp assembly 135 then is rotated relative to the lower clamp assembly 140 to further tighten the threads between the first and second tubulars.

In the event that the center axis of the tubulars when gripped by the grip assemblies 145, 150 is offset from the center axis of the wrench assembly 100 (identified by axis TA of the wrench tool 100 shown in FIG. 5), which is the axis about which torque is normally applied, the upper clamp assembly 135 is configured to move laterally relative to the lower clamp assembly 140 so that the torque can be applied about the center axis of the tubulars as further described below.

The wrench assembly 105 shown in FIGS. 1-5 also includes a switch mechanism 155 which is part of an eccentricity sensing circuit according to one embodiment. The switch mechanism 155 is coupled to the wrench assembly 105 at opposing sides thereof as shown in FIG. 4. The switch mechanisms 155 are utilized to sense misalignment between the upper clamp assembly 135 and the lower clamp assembly 140 such as when the center axis of the tubulars is offset from the axis TA as will be further described below. The switch mechanism 155 and corresponding eccentricity sensing circuit will be described in more detail with respect to FIGS. 12A-12C.

The wrench tool 100 also includes an alignment device 500 as a portion of another embodiment of an eccentricity sensing circuit. The alignment device 500 is configured to adjust the axis about which the wrench assembly 105 applies torque by allowing the upper clamp assembly 135 to move laterally relative to the lower clamp assembly 140. The alignment device 500 enables the upper clamp assembly 135 to move to a position out of alignment with the lower clamp assembly 140 to apply torque about an axis that is aligned with the center axis of the tubulars, which may not be along the axis TA of the wrench tool 100 but instead is offset from the axis TA of the wrench tool 100. After the torque is applied, the alignment device 500 forces the upper clamp assembly 135 back into alignment with the lower clamp assembly 140.

Figure 6:
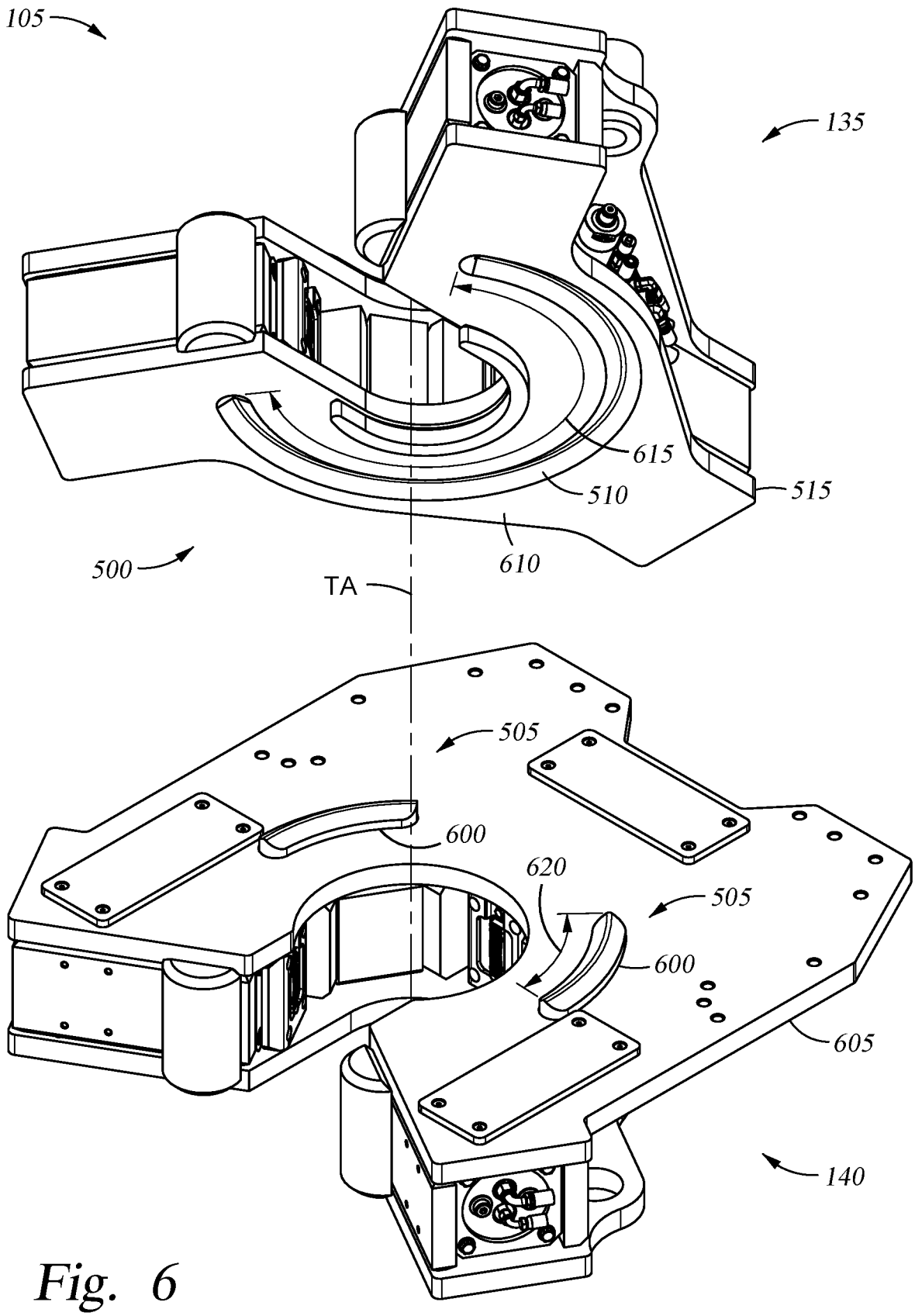
FIG. 6 is an isometric exploded view of the wrench tool.

As shown in FIGS. 5 and 6, the alignment device 500 includes one or more wedges 505 formed on the lower clamp assembly 140 that contact a groove 510 formed on the upper clamp assembly 135. The wedges 505 are disposed through an upper plate member 605 of the lower clamp assembly 140. The groove 510 is formed in a lower plate member 515 of the upper clamp assembly 135.

The tapered surfaces of the wedges 505 engage the tapered surfaces of the groove 510 such that the upper clamp assembly 135 can move laterally in the X and/or Y directions into and out of alignment with the lower clamp assembly 140. When torque is applied by the wrench assembly 105, the upper clamp assembly 135 (which is gripping the upper tubular) is rotated relative to the lower clamp assembly 140 (which is gripping the lower tubular). As the upper clamp assembly 135 rotates relative to the lower clamp assembly 140, if the center axis of the tubular is offset from the center axis of the wrench assembly 105, then the tapered surfaces of the groove 510 forces the wedges 505 downwardly (in at least the Z direction) to allow the upper clamp assembly 135 to move laterally (in at least the X and/or Y directions) relative to the lower clamp assembly 140 to apply torque about the center axis of the tubulars. After the torque is applied, the wedges 505 are biased upward so that the tapered surfaces of the wedges 505 force the upper clamp assembly 135 back into alignment with the lower clamp assembly 140.

FIG. 6 is an isometric exploded view of the wrench assembly 105 that clearly shows the wedges 505 and the groove 510. Each of the wedges 505 extend up through an opening 600 formed in the upper plate member 605 of the lower clamp assembly 140. Each of the wedges 505 are biased toward the upper clamp assembly 135 by a biasing member, such as a spring 805 shown in FIG. 8. The groove 510 is formed as a recess in a surface 610 of the lower plate member 515 of the upper clamp assembly 135. Each of the groove 510 and the wedges 505 are curved and shaped as an arc. The groove 510 may include an arc length 615 that is greater than an arc length 620 of each of the wedges 505. The curved shape of the groove 510 and the wedges 505 allows relative rotation between the lower clamp assembly 140 and the upper clamp assembly 135. In an alternative embodiment, the wedges 505 can be disposed through the upper clamp assembly 135 and the groove 510 can be located on the lower clamp assembly 140.

Figure 7:
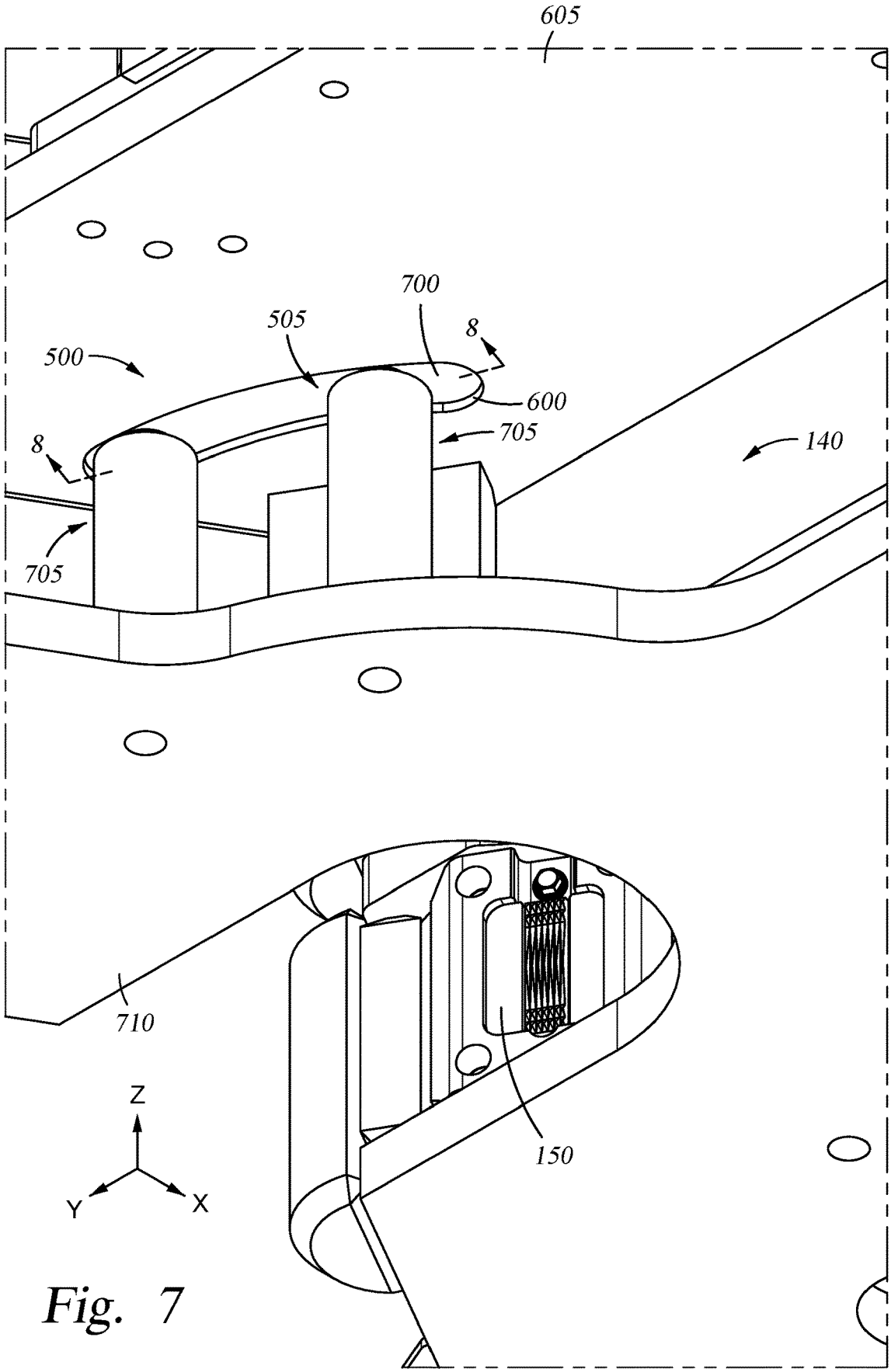
FIG. 7 is an isometric bottom view of a portion of the wrench assembly.

FIG. 7 is an isometric bottom view of a portion of the lower clamp assembly 140 showing a bottom surface 700 of one of the wedges 505. A biasing assembly 705 is coupled between the bottom surface 700 of the wedge 505 and a lower plate member 710 of the lower clamp assembly 140. The biasing assembly 705 biases the wedges 505 upward toward the upper clamp assembly 135.

Figure 8:
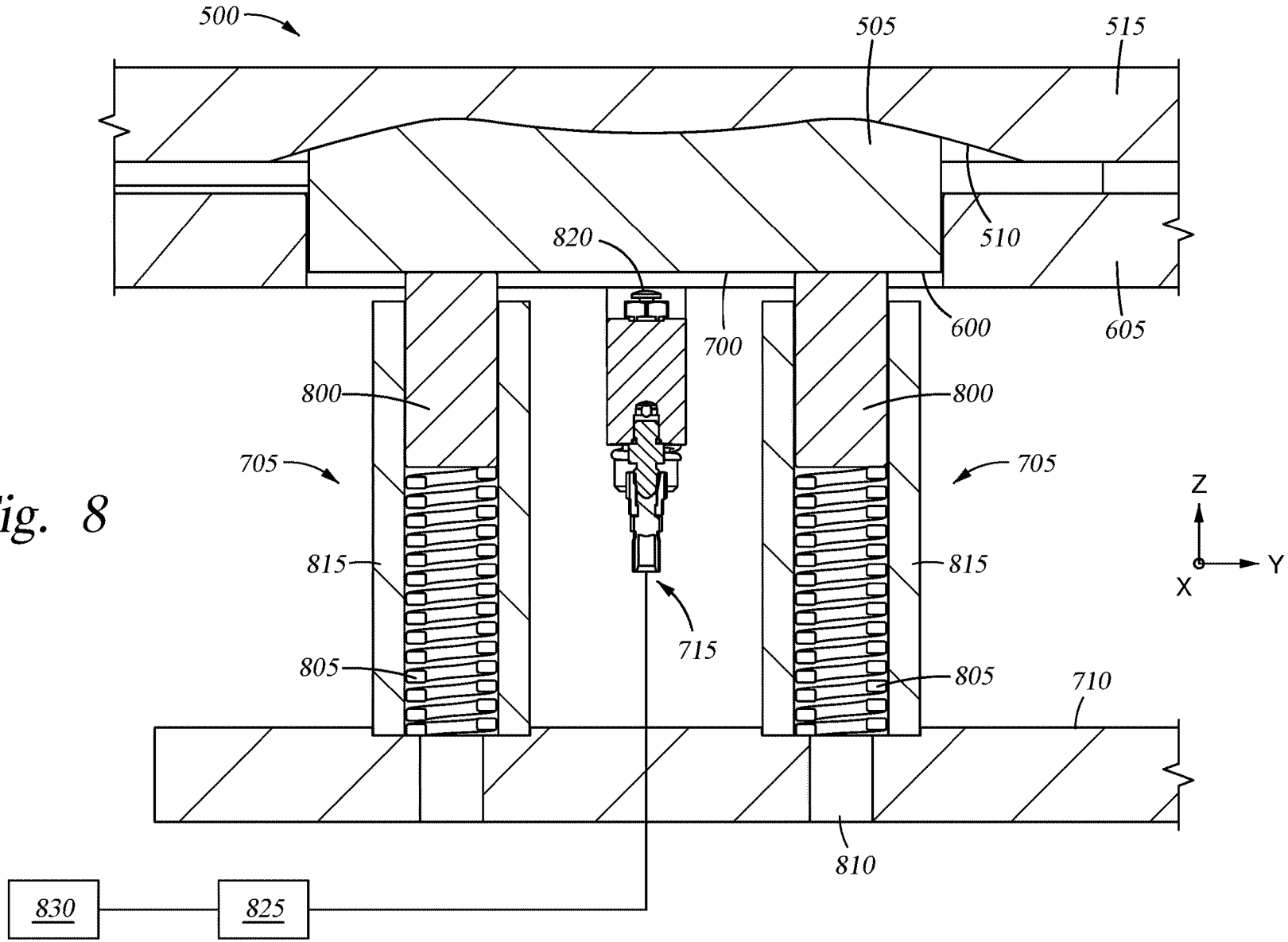
FIG. 8 is a sectional view of a portion of the wrench assembly along lines 8-8 of FIG. 7.

In some embodiments, the alignment device 500 includes a switch mechanism 715 (as shown in FIG. 8) configured to shut off the wrench assembly 105. The switch mechanism 715 may be utilized as a limit switch. Extreme lateral movement of the upper clamp assembly 135 relative to the lower clamp assembly 140 forces the wedges 505 downwardly into contact with the switch mechanism 715 and causes the wrench assembly 105 to stop applying torque. If the wedges 505 move toward the lower plate member 710 of the lower clamp assembly 140 a predetermined distance, the bottom surface 700 of the wedges 505 contacts a button 820 (shown in FIGS. 8-10) coupled to a bracket 720 of the switch mechanism 715, which controls the opening or closing of a valve that controls power fluid flow to operate the wrench assembly 105.

FIG. 8 is a sectional view of a portion of the alignment device 500 along lines 8-8 of FIG. 7. As shown in FIG. 8, the wedge 505 is biased upwardly into contact with the groove 510 by two biasing assemblies 705, each of which includes a pin 800 and a spring 805. The spring 805 may be supported by a support member 810 (e.g. such as another pin) that is coupled to the lower plate member 710. A cylindrical cover 815 may at least partially enclose the pin 800 and the spring 805. The biasing assembly 705 allows the wedge 505 to be moved downward relative to the upper plate member 605 of the lower clamp assembly 140 in the Z direction, thereby compressing the spring 805. If the wedge 505 is moved in the Z direction beyond a predetermined distance, the bottom surface 700 contacts the button 820 which actuates (opens or closes) a valve 900 as shown in FIGS. 9 and 10, which controls power fluid flow (such as hydraulic fluid) to the wrench assembly 105.

During operation, the valve 900 is normally maintained in a closed position. However, when the bottom surface 700 of the wedge 505 contacts the button 820, the power fluid is allowed to flow through the valve 900 to a hydraulic control circuit 825 (or an eccentricity sensing circuit 1100 described below in FIGS. 11A-11C). The circuit 825 stops torque application by the wrench assembly 105 by depressurizing the hydraulic cylinders 125 (shown in FIG. 1). If torque application is stopped by the circuit 825, an operator may release the tubulars from the wrench assembly 105, and then re-actuate the wrench assembly 105 to re-grip the tubulars to position the center axis of the tubular closer to or in alignment with the axis TA of the wrench tool 100. While only one switch mechanism 715 is shown, another switch mechanism may be used in conjunction with the wrench tool 100. However, as the upper plate member 605 of the lower clamp assembly 140 is maintained in a parallel or substantially parallel relationship with the lower plate member 515 of the upper clamp assembly 135 during torque application, only a single switch mechanism 715 is needed.

Figure 9:
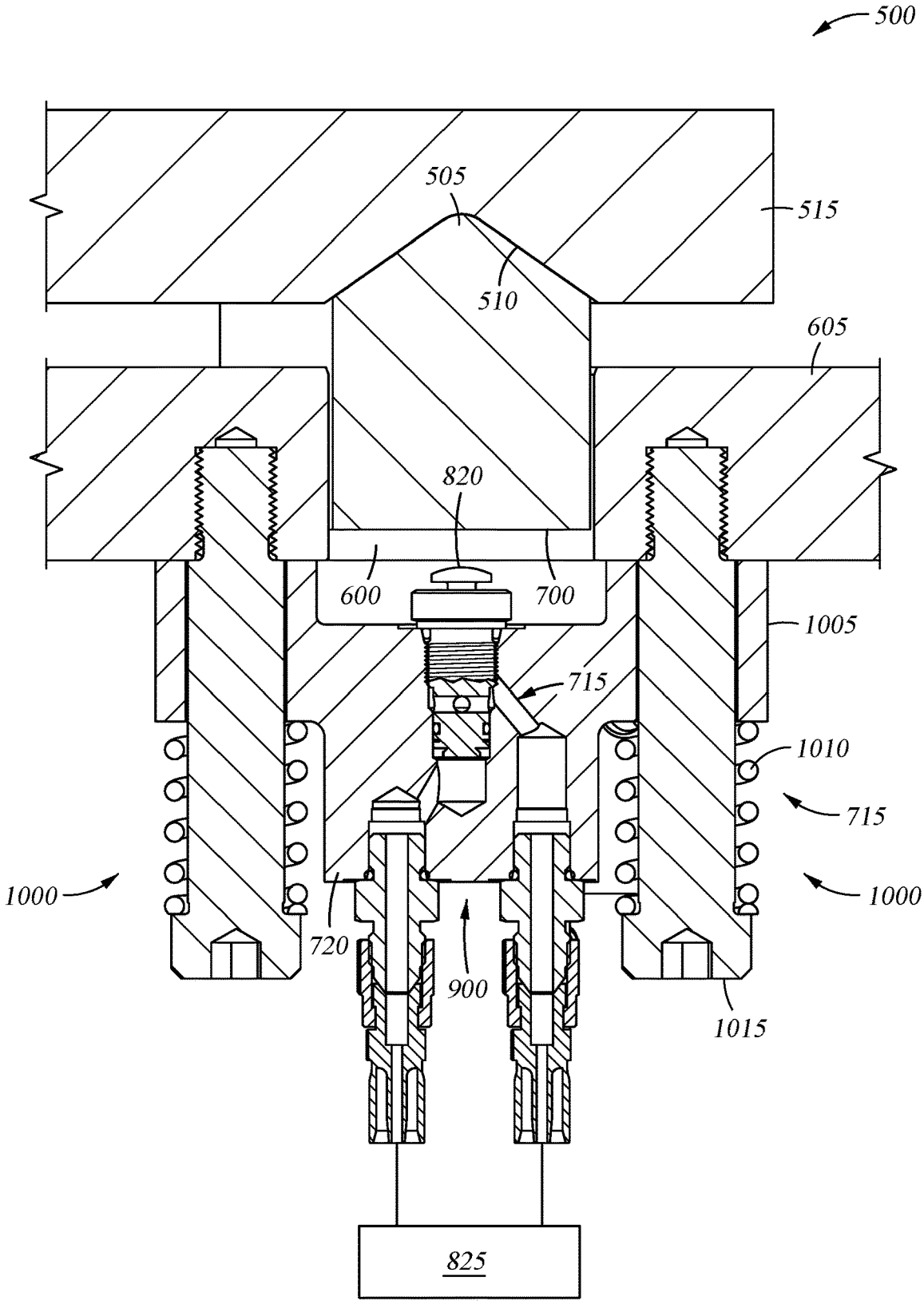
FIG. 9 is a sectional view of a portion of the wrench assembly rotated about 90 degrees from the sectional view shown in FIG. 8.
Figure 10:
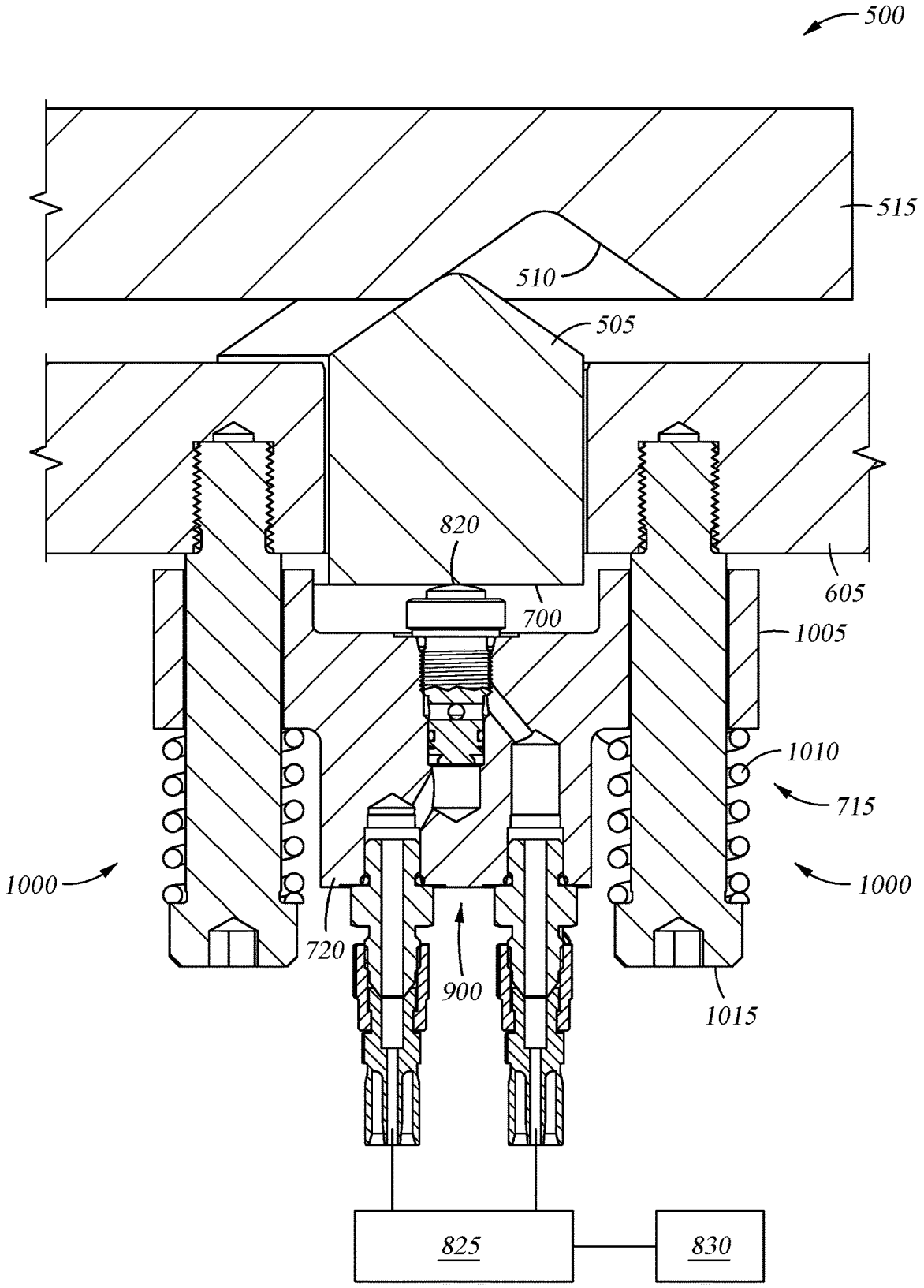
FIG. 10 is a sectional view of the portion of the wrench assembly shown in FIG. 9 in a position different than the position shown in FIG. 9.

FIG. 9 is a sectional view of a portion of the alignment device 500 in a first position where the upper clamp assembly 135 is in alignment with the lower clamp assembly 140 such that the wedges 505 are centrally positioned within the groove 510. FIG. 10 is a sectional view of the same portion of the alignment device 500 as shown in FIG. 9 but in a second position where the upper clamp assembly 135 has moved laterally relative to the lower clamp assembly 140 such that the tapered surface of the groove 510 has forced the wedges 505 downwardly (against the pin 800 to compress the springs 805 shown in FIG. 8) and into contact with the button 820 of the switch mechanism 715. After release of the tubulars by the upper clamp assembly 135, the springs 805 and the pins 800 force the tapered surface of the wedges 505 up against the tapered surface of the groove 510 to force the upper clamp assembly 135 back into alignment with the lower clamp assembly 140.

To prevent damage to the switch mechanism 715 and/or the valve 900, for example from the wedge 505 moving after contact with the button 820, one or more biasing assemblies 1000 may be coupled between a body 1005 of the valve 900 and the upper plate member 605 of the lower clamp assembly 140. Each of the biasing assemblies 1000 may include a spring 1010 and a fastener 1015 coupled to the upper plate member 605 of the lower clamp assembly 140. The biasing assemblies may be configured to allow the body 1005 of the valve 900 to compress the springs 1010 to compensation for any excessive force applied to the valve 900 by the wedges 505.

Figure 11A:
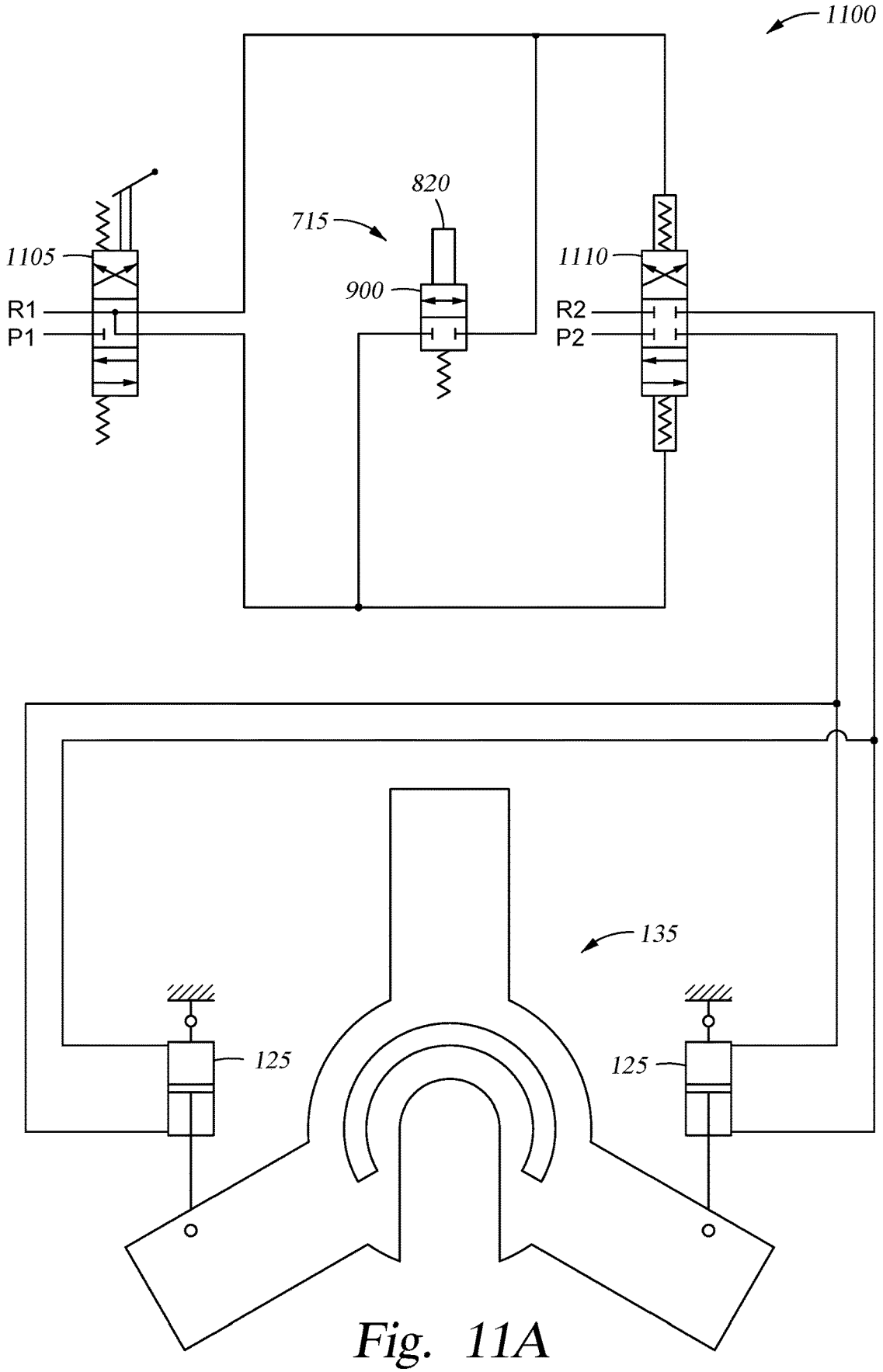
FIGS. 11A-11C are schematic representations of an eccentricity sensing circuit according to one embodiment.
Figure 11B:
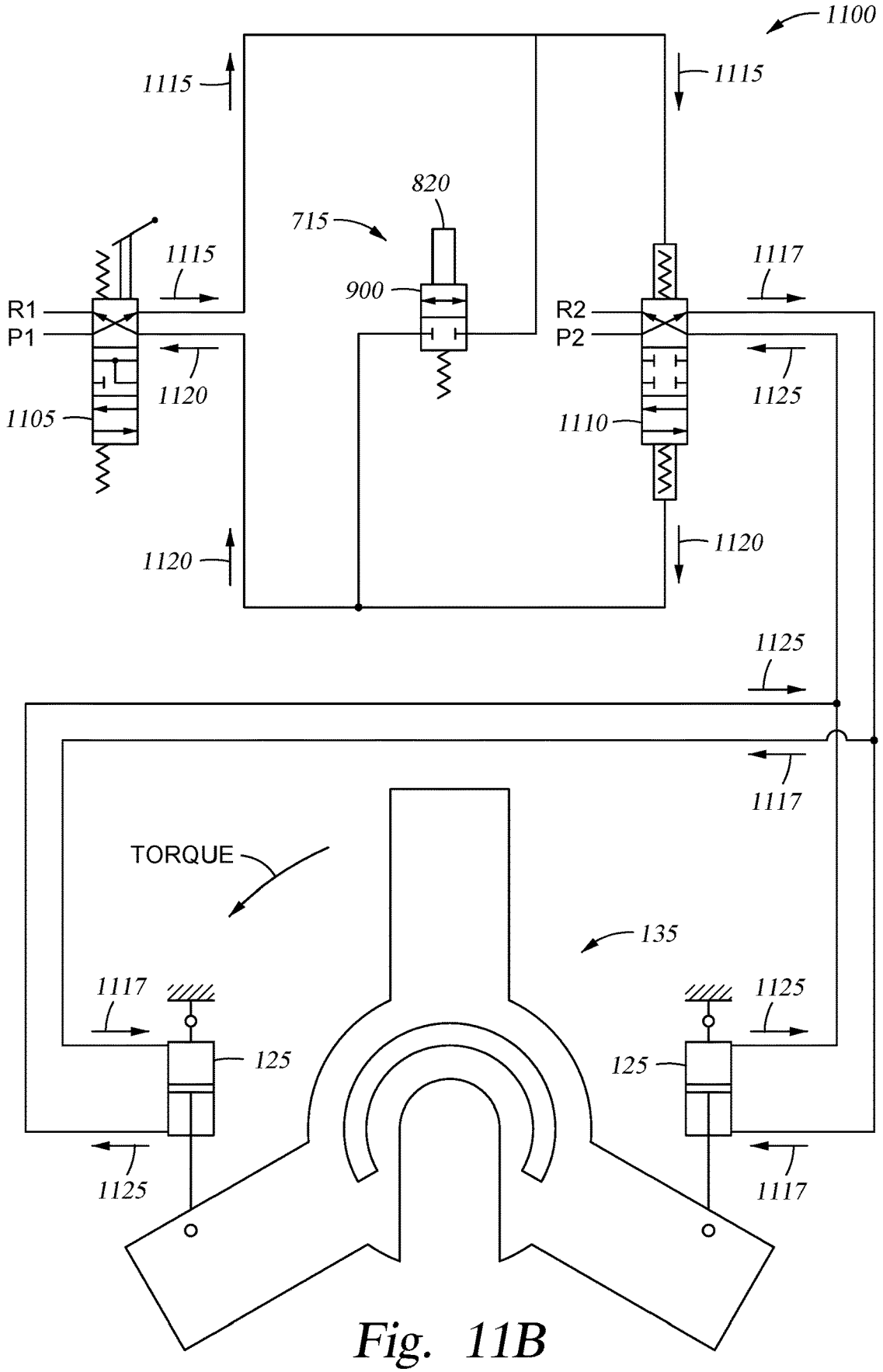
Figure 11C:
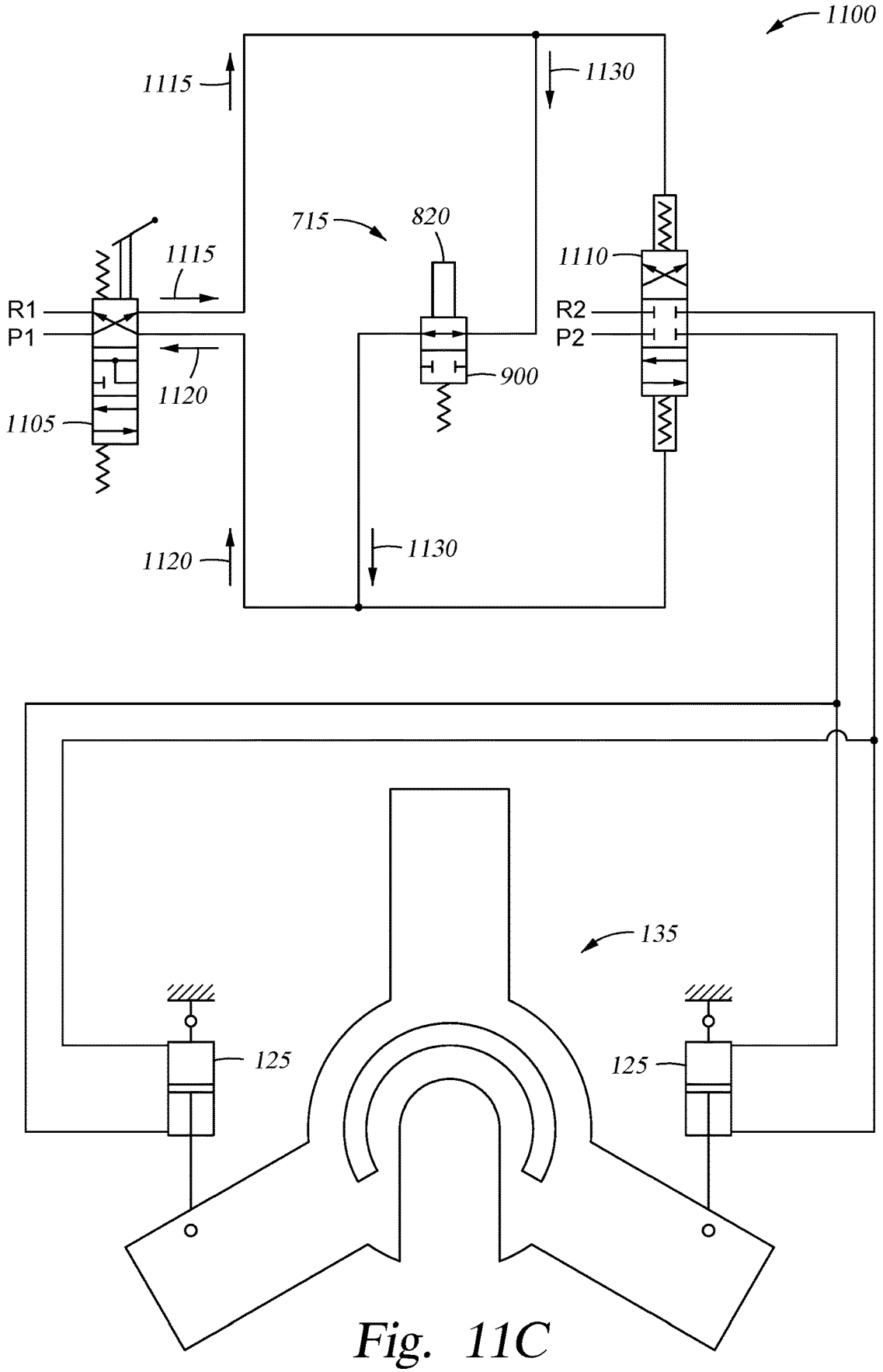

FIGS. 11A-11C are schematic representations of an eccentricity sensing circuit according to one embodiment. FIGS. 11A-11C show an eccentricity sensing circuit 1100 that may be utilized with the switch mechanism 715 shown in FIGS. 7-10. In the eccentricity sensing circuit 1100, the letter "P" represents pressure and the letter "R" represents return.

The eccentricity sensing circuit 1100 is part of a hydraulic control system that controls the flow of the control fluid supplied to the hydraulic cylinders 125 to control the torque applied by the wrench tool 100 when making up or breaking out a tubular connection. The eccentricity sensing circuit 1100 includes a pressure control valve 1105 that controls the actuation of a main spool valve 1110, which is configured to control the supply of fluid to the hydraulic cylinders 125 to conduct either a make-up operation or a break out operation.

In FIG. 11A, the pressure control valve 1105 is in a neutral position such that all the fluid in the eccentricity sensing circuit 1100 is directed to a return R1 and no force is applied to the main spool valve 1110. When no force is applied to the main spool valve 1100, it is biased into a neutral position such that no fluid can be supplied to either of the hydraulic cylinders 125 and the wrench tool 100 cannot apply any torque.

In FIG. 11B, in a make-up operation for example, the pressure control valve 1105 is actuated into an operating position such that pressurized fluid from P1 flows along flow path 1115 to actuate the main spool valve 1110. The main spool valve 1110 is actuated by the pressurized fluid in the flow path 1115 into an operating position such that pressurized fluid from P2 is supplied to the hydraulic cylinders 125 via flow paths 1117 to actuate the wrench tool 100. Fluid in flow path 1125 is returned to a return R2. Fluid in flow path 1120 is returned to the return R1.

The wrench tool 100 is actuated to apply torque to a tubular connection as described above. The switch mechanism 715 and the valve 900 remain in a closed position such that there is no fluid communication between the flow paths 1115 and 1120. The valve 900 is biased into the closed position. However, if extreme lateral movement of the upper clamp assembly 135 relative to the lower clamp assembly 140 is experienced during torque application, the bottom surface 700 of one of the wedges 505 of the alignment device 500 contacts the button 820 which actuates the valve 900 into an open position.

In FIG. 11C, the valve 900 opens fluid communication between the flow paths 1115 and 1120 via a flow path 1130 such that any pressurized fluid from P1 in flow path 1115 flows through flow path 1130 into flow path 1120 and back to the return R1. When the valve 900 is actuated into the open position, a portion of the flow path 1115 is short circuited and halts fluid flow to the main spool valve 1110 such that the main spool valve 1110 is biased back into the neutral position to stop fluid flow to the hydraulic cylinders 125. Stopping fluid flow to the hydraulic cylinders 125 tolls torque application by the wrench tool 100, and when torque application is stopped, an operator may release the tubular from the upper clamp assembly 135, and then re-grip the tubular to position the center axis of the tubular closer to or in alignment with the axis TA of the wrench tool 100. A reverse of fluid flow through the flow paths 1115, 1120, 1130, 1117, and 1125 would occur in a break-out operation.

Figure 12A:
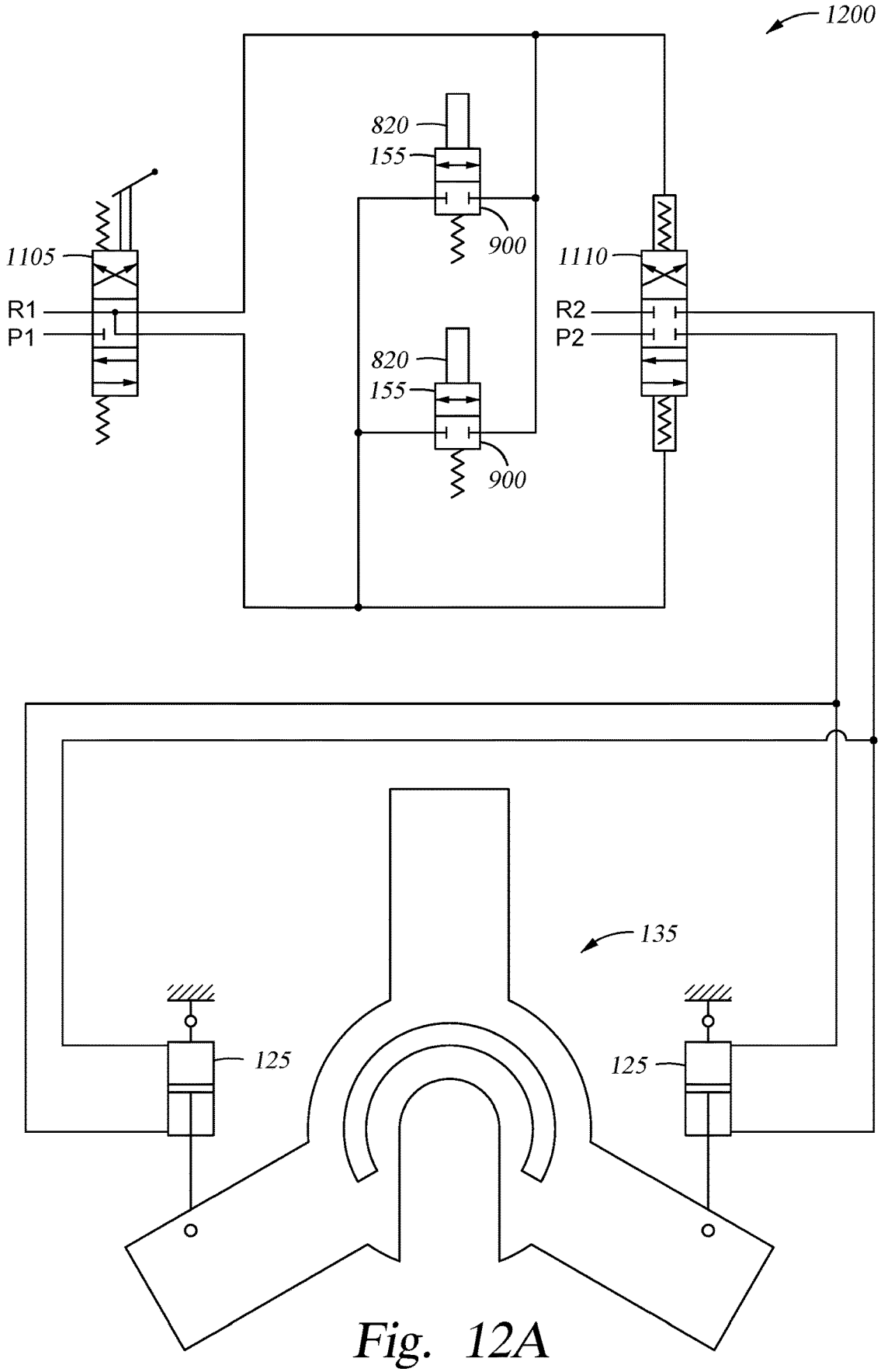
FIGS. 12A-12C are schematic representations of an eccentricity sensing circuit according to another embodiment.
Figure 12B:
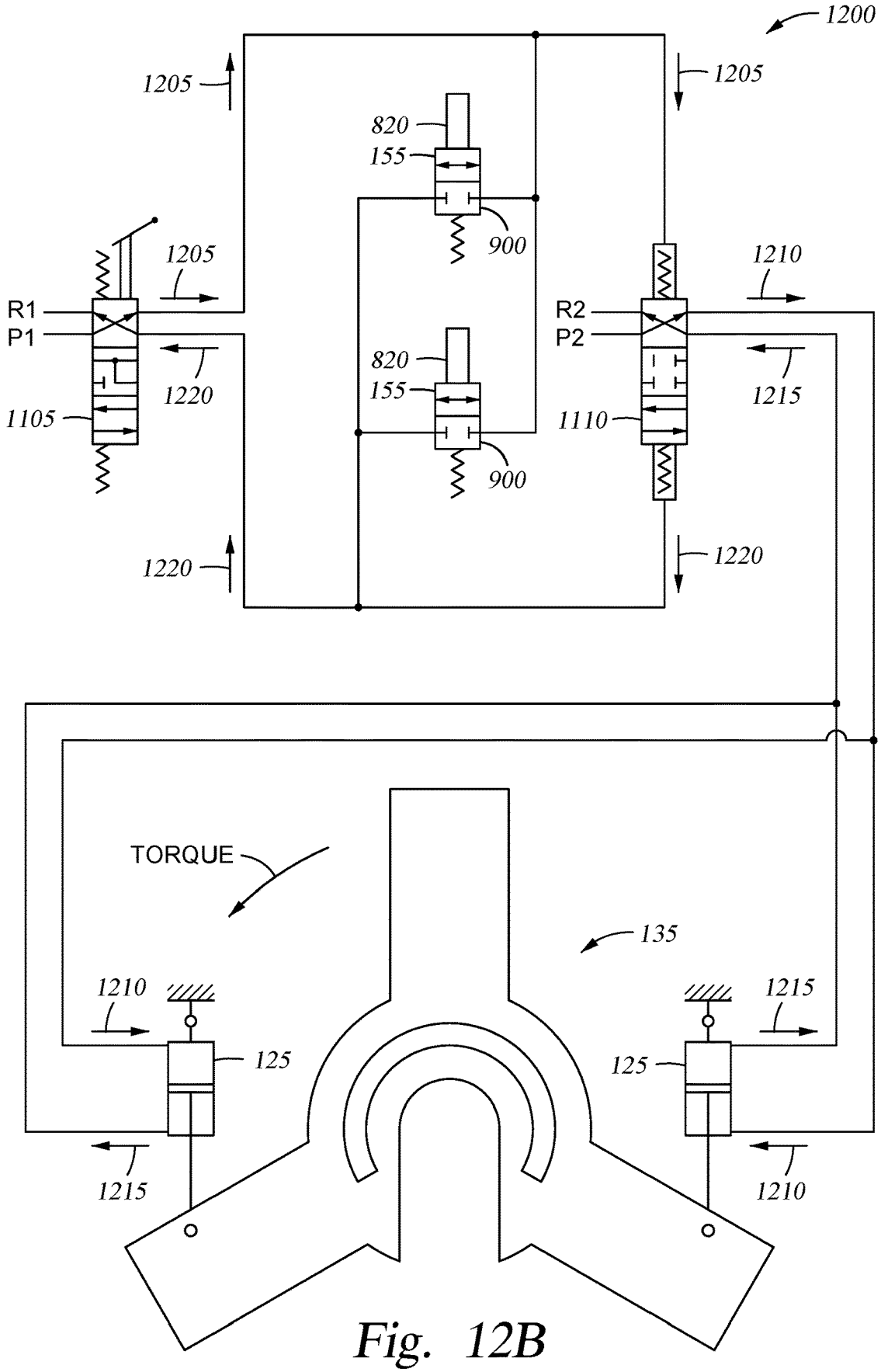
Figure 12C:
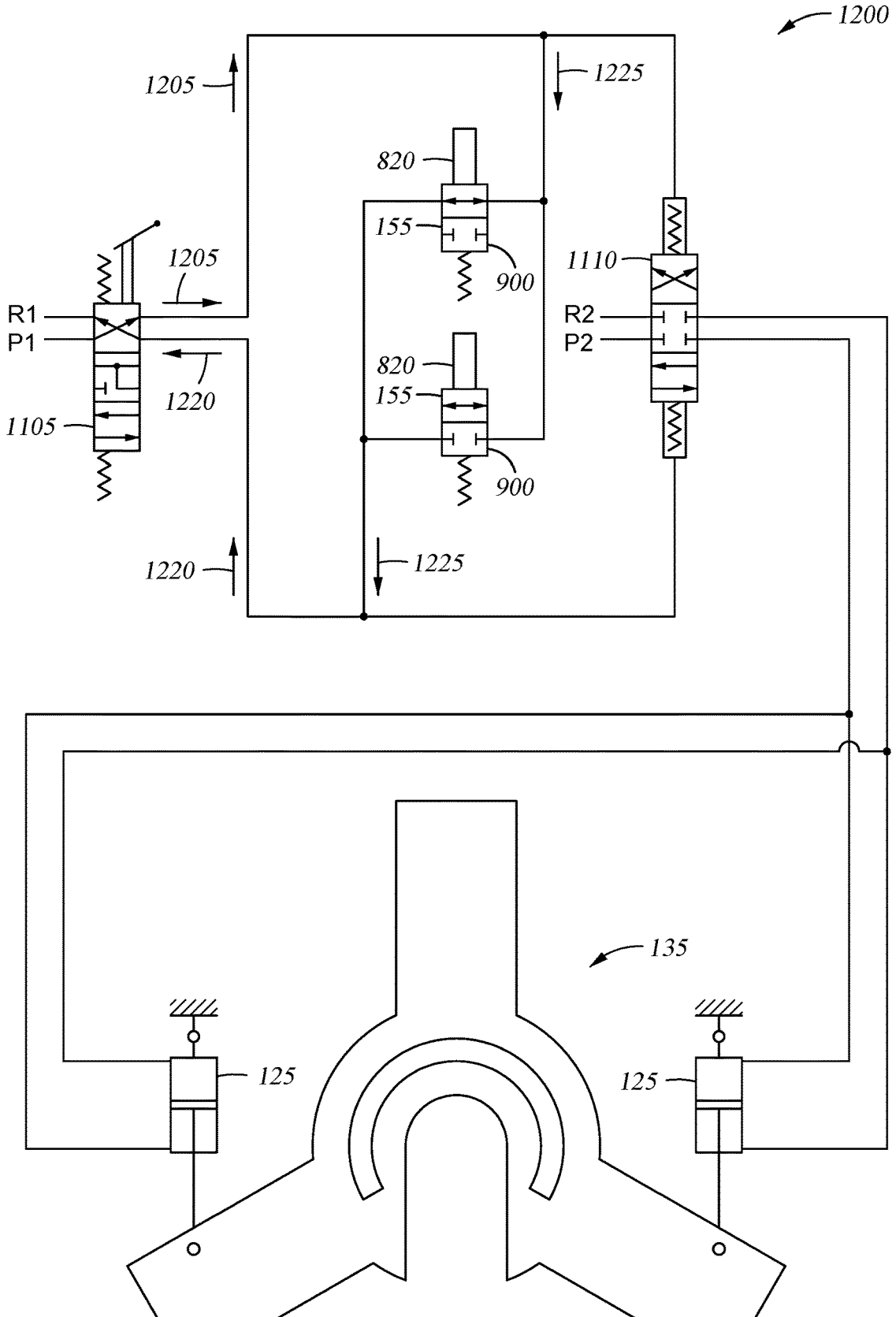

FIGS. 12A-12C are schematic representations of an eccentricity sensing circuit according to another embodiment. FIGS. 12A-12C show an eccentricity sensing circuit 1200 utilizing the switch mechanism 155 shown in FIGS. 1, 2, and 4. The eccentricity sensing circuit 1200 is part of a hydraulic control system that controls the flow of the control fluid supplied to the hydraulic cylinders 125 to control the torque applied by the wrench tool 100 when making up or breaking out a tubular connection. In the eccentricity sensing circuit 1200, the letter "P" represents pressure and the letter "R" represents return.

The eccentricity sensing circuit 1200 is part of a hydraulic control system that controls the flow of the control fluid supplied to the hydraulic cylinders 125 to control the torque applied by the wrench tool 100 when making up or breaking out a tubular connection. The eccentricity sensing circuit 1200 includes a pressure control valve 1105 that controls the actuation of a main spool valve 1110, which is configured to control the supply of fluid to the hydraulic cylinders 125 to conduct either a make-up operation or a break out operation.

In FIG. 12A, the pressure control valve 1105 is in a neutral position such that all the fluid in the eccentricity sensing circuit 1200 is directed to a return R1 and no force is applied to the main spool valve 1110. When no force is applied to the main spool valve 1100, it is biased into a neutral position such that no fluid can be supplied to either of the hydraulic cylinders 125 and the wrench tool 100 cannot apply any torque.

In FIG. 12B, in a make-up operation for example, the pressure control valve 1105 is actuated into an operating position such that pressurized fluid from P1 flows along flow path 1205 to actuate the main spool valve 1110. The main spool valve 1110 is actuated by the pressurized fluid in the flow path 1205 into an operating position such that pressurized fluid from P2 is supplied to the hydraulic cylinders 125 via flow paths 1210 to actuate the wrench tool 100. Fluid in flow path 1215 is returned to a return R2. Fluid in flow path 1220 is returned to the return R1.

The wrench tool 100 is actuated to apply torque to a tubular connection as described above. The switch mechanisms 155 and the valves 900 remain in a closed position such that there is no fluid communication between the flow paths 1205 and 1220. The valves 900 are biased into the closed position. However, if extreme lateral movement of the upper clamp assembly 135 relative to the lower clamp assembly 140 is experienced during torque application, a portion of the wrench tool 100 contacts buttons 820 of the switch mechanisms 155 which actuate the valves 900 into an open position.

In FIG. 12C, the valves 900 open fluid communication between the flow paths 1205 and 1220 via a flow path 1225 such that any pressurized fluid from P1 in flow path 1205 flows through flow path 1225 into flow path 1220 and back to the return R1. When the valves 900 are actuated into the open position, a portion of the flow path 1205 is short circuited and halts fluid flow to the main spool valve 1110 such that the main spool valve 1110 is biased back into the neutral position to stop fluid flow to the hydraulic cylinders 125. Stopping fluid flow to the hydraulic cylinders 125 tolls torque application by the wrench tool 100, and when torque application is stopped, an operator may release the tubular from the upper clamp assembly 135, and then re-grip the tubular to position the center axis of the tubular closer to or in alignment with the axis TA of the wrench tool 100. A reverse of fluid flow through the flow paths 1205, 1220, 1225, 1210, and 1215 would occur in a break-out operation.

Figure 13A:
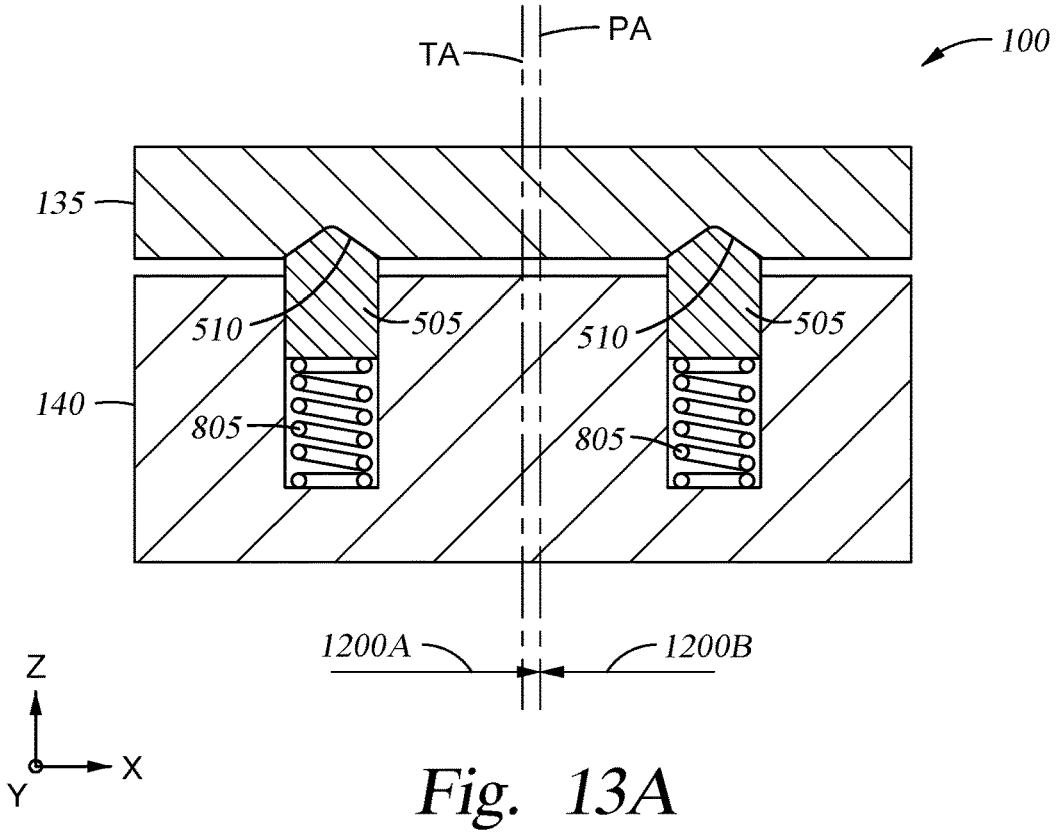
FIGS. 13A and 13B are schematic representations of the wrench tool in a pre-torque position and a torque application position, respectively.
Figure 13B:
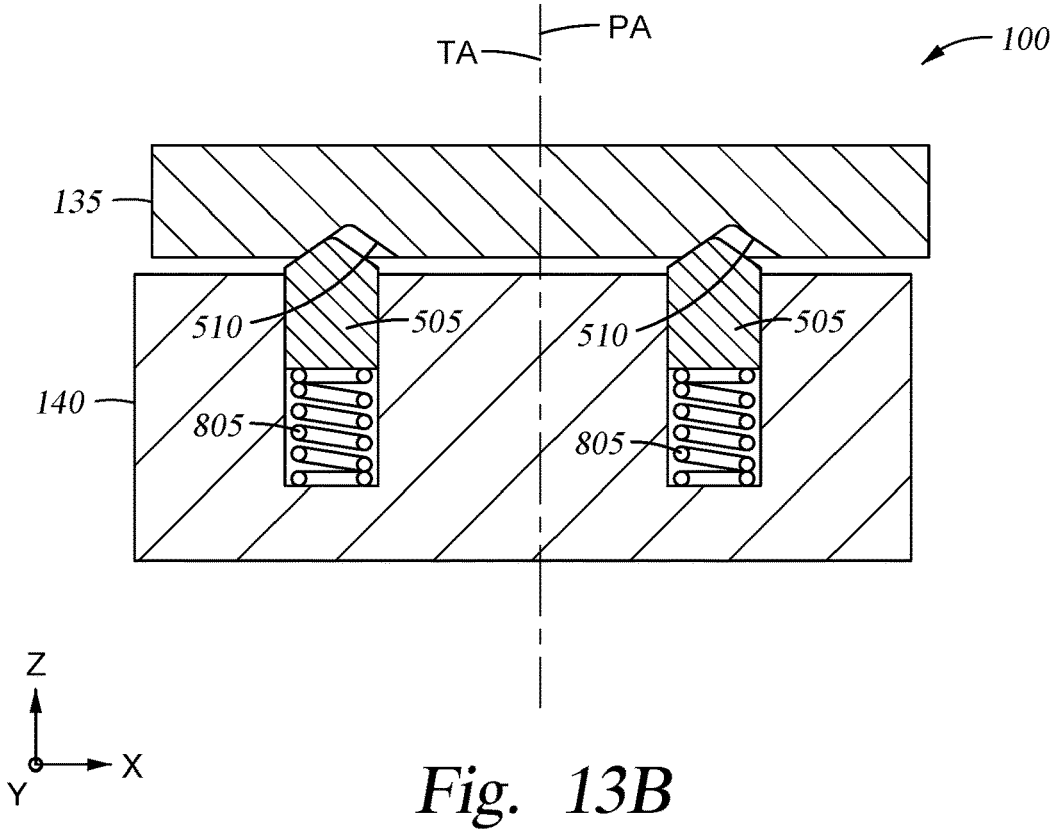

FIGS. 13A and 13B are schematic representations of the wrench tool 100 in a pre-torque position and a torque application position, respectively, when the center axis PA of a tubular is offset from the center axis TA of the wrench tool 100. As shown in FIG. 13A and FIG. 13B, the axis PA is not aligned with the axis TA, and the axis PA is more misaligned relative to the axis TA in FIG. 13B. The misalignment of the center axis PA of the tubular relative to the center axis TA of the wrench tool 100 may occur by, for example, grip assemblies 150, depicted in FIGS. 1-3, that push the tubular out of alignment with the axis TA during initial gripping of the tubular.

While the misalignment of the center axis TA and the center axis PA is exaggerated in FIGS. 13A and 13B, the wrench tool 100 as disclosed herein may adjust for this misalignment. For example, as shown in FIG. 13B, the alignment device 500, consisting of the groove 510 and one or more wedges 505 biased by springs 805, allows the wrench assembly 110 to shift laterally and rotate about the center axis PA during torque application as described above. The torque alignment includes lateral movement of the upper clamp assembly 135 relative to the lower clamp assembly 140 in the X and/or Y directions, as well as movement of the wedges 505 forced downward in the Z direction against the bias of and compressing the springs 805. Upon release of the tubular, the springs 805 force the wedges 505 back up against the groove 510 to re-center the upper clamp assembly 135 with the lower clamp assembly 140 as shown in FIG. 13A.

While the foregoing is directed to embodiments of the disclosure, other and further embodiments of the disclosure thus may be devised without departing from the basic scope thereof, and the scope thereof is determined by the claims that follow.

The invention claimed is:

1. A wrench assembly, comprising;

a lower clamp assembly;

an upper clamp assembly coupled to the lower clamp assembly that is adapted to move laterally relative to the lower clamp assembly when rotated relative to the lower clamp assembly; and an eccentricity sensing switch coupled between the upper clamp assembly and the lower clamp assembly and configured to stop one or more of the lower or upper clamp assembly from applying torque to a tubular connection, the eccentricity sensing switch comprising a valve in fluid communication with a hydraulic fluid circuit that supplies a pressurized fluid to the wrench assembly, wherein the hydraulic fluid circuit comprises a first flow path that flows to the wrench assembly, a second flow path that flows to a return, and a third flow path that flows between the first flow path and the second flow path, wherein the valve is movable between a closed position and an open position, and wherein in the open position the valve opens the third flow path to flow the pressurized fluid from the first flow path to the second flow path.

2. The wrench assembly of claim 1, wherein the eccentricity sensing switch comprises a portion of an alignment device disposed between the upper and lower clamp assemblies, the alignment device comprises a wedge that engages a groove, and a bottom surface of the wedge is movable to contact a button of the eccentricity sensing switch to move the valve to the open position.

3. The wrench assembly of claim 1, wherein the eccentricity sensing switch comprises a portion of an alignment device disposed between the upper and lower clamp assemblies, and the alignment device comprises a wedge that engages a groove.

4. The wrench assembly of claim 3, wherein each of the wedge and the groove comprise an arcuate shape.

5. The wrench assembly of claim 3, wherein the wedge is coupled to a spring that biases the wedge into the groove.

6. The wrench assembly of claim 5, wherein the spring is disposed about a pin that aligns the wedge.

7. The wrench assembly of claim 6, wherein the spring and the pin are at least partially housed within a cylindrical cover.

8. The wrench assembly of claim 1, wherein a wedge is biased into engagement with a groove, the valve is biased into a closed position, the groove is formed in a lower plate of the upper clamp assembly, and the wedge is disposed at least partially through an upper plate of the lower clamp assembly.

9. A wrench assembly, comprising;

an upper clamp assembly;

a lower clamp assembly coupled to the upper clamp assembly;

an alignment device disposed between the upper and lower clamp assemblies, wherein the alignment device is configured to adjust an axis about which the wrench assembly applies torque by allowing the upper clamp assembly to move laterally relative to the lower clamp assembly; and an eccentricity sensing switch coupled between the upper clamp assembly and the lower clamp assembly and configured to stop one or more of the lower or upper clamp assembly from applying torque to a tubular connection, the eccentricity sensing switch comprising a valve in fluid communication with a hydraulic fluid circuit that supplies a pressurized fluid to the wrench assembly, wherein the hydraulic fluid circuit comprises a first flow path that flows to the wrench assembly, a second flow path that flows to a return, and a third flow path that flows between the first flow path and the second flow path, wherein the valve is movable between a closed position and an open position, and wherein in the open position the valve opens the third flow path to flow the pressurized fluid from the first flow path to the second flow path.

10. The wrench assembly of claim 9, wherein the alignment device comprises a wedge that engages a groove, and a bottom surface of the wedge is movable to contact a button of the eccentricity sensing switch to move the valve to the open position, the wedge being movable relative to an upper plate of the lower clamp assembly.

11. The wrench assembly of claim 10, wherein each of the wedge and the groove comprise an arcuate shape.

12. The wrench assembly of claim 10, wherein the wedge is biased into engagement with the groove, the valve is biased into the closed position, the groove is formed in a lower plate of the upper clamp assembly, and the wedge is disposed at least partially through the upper plate of the lower clamp assembly.

13. The wrench assembly of claim 10, wherein the wedge is coupled to a spring that biases the wedge into the groove.

14. The wrench assembly of claim 9, wherein the alignment device comprises two wedges configured to engage with a groove.

15. The wrench assembly of claim 14, wherein each of the wedges and the groove comprise an arcuate shape.

16. A wrench assembly, comprising;

an upper clamp assembly;

a lower clamp assembly coupled to the upper clamp assembly;

an alignment device disposed between the upper and lower clamp assemblies, wherein the alignment device is configured to adjust an axis about which the wrench assembly applies torque by allowing the upper clamp assembly to move laterally relative to the lower clamp assembly, wherein the alignment device comprises a wedge that engages a groove, the wedge being movable relative to an upper plate of the lower clamp assembly; and an eccentricity sensing switch coupled between the upper clamp assembly and the lower clamp assembly and configured to stop one or more of the lower or upper clamp assembly from applying torque to a tubular connection, the eccentricity sensing switch comprising a valve in fluid communication with a hydraulic fluid circuit that supplies a pressurized fluid to the wrench assembly, wherein the hydraulic fluid circuit comprises a first flow path that flows to the wrench assembly, a second flow path that flows to a return, and a third flow path that flows between the first flow path and the second flow path, wherein the valve is movable between a closed position and an open position, and wherein in the open position the valve opens the third flow path to flow the pressurized fluid from the first flow path to the second flow path.

17. The wrench assembly of claim 16, further comprising a second eccentricity sensing switch, the second eccentricity sensing switch comprising a second valve in fluid communication with the hydraulic fluid circuit that supplies the pressurized fluid to the wrench assembly.

18. A wrench assembly, comprising;

a lower clamp assembly;

an upper clamp assembly coupled to the lower clamp assembly that is adapted to move laterally relative to the lower clamp assembly when rotated relative to the lower clamp assembly; and an eccentricity sensing switch coupled between the upper clamp assembly and the lower clamp assembly and configured to stop one or more of the lower or upper clamp assembly from applying torque to a tubular connection, the eccentricity sensing switch comprising a valve in fluid communication with a hydraulic fluid circuit that supplies a pressurized fluid to the wrench assembly, wherein a wedge is biased into engagement with a groove, the valve is biased into a closed position, the groove is formed in a lower plate of the upper clamp assembly, and the wedge is disposed at least partially through an upper plate of the lower clamp assembly.

19. The wrench assembly of claim 18, wherein the eccentricity sensing switch comprises a portion of an alignment device disposed between the upper and lower clamp assemblies, the alignment device comprises the wedge that engages the groove, and a bottom surface of the wedge is movable to contact a button of the eccentricity sensing switch to move the valve to an open position.

* * * * *